US007461518B2

(12) United States Patent
Higashida

(10) Patent No.: US 7,461,518 B2
(45) Date of Patent: Dec. 9, 2008

(54) FAN AND AIR CONDITIONER

(75) Inventor: Masahito Higashida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 317 days.

(21) Appl. No.: 10/581,121

(22) PCT Filed: Sep. 6, 2005

(86) PCT No.: PCT/JP2005/016306

§ 371 (c)(1),
(2), (4) Date: May 31, 2006

(87) PCT Pub. No.: WO2006/035574

PCT Pub. Date: Apr. 6, 2006

(65) Prior Publication Data

US 2007/0116559 A1 May 24, 2007

(30) Foreign Application Priority Data

Sep. 28, 2004 (JP) ..... 2004-282405

(51) Int. Cl.
*F25D 17/06* (2006.01)

(52) U.S. Cl. ..... 62/419; 62/414

(58) Field of Classification Search ..... 62/419, 62/414, 412, 411; 165/121
See application file for complete search history.

(56) References Cited

U.S. PATENT DOCUMENTS 3,877,542 A * 4/1975 Paoli ..... 180/120
5,281,098 A * 1/1994 Glynn et al. ..... 416/221
5,439,349 A * 8/1995 Kupferberg ..... 415/212.1
5,474,422 A 12/1995 Sullivan
6,273,679 B1 * 8/2001 Na ..... 415/204

FOREIGN PATENT DOCUMENTS

| | | | |
|---|---|---|---|
| DE | 4140129 | A1 | 7/1992 |
| FR | 2671834 | A1 | 7/1992 |
| GB | 2251893 | A | 7/1992 |
| JP | 61-36219 | U | 3/1986 |
| JP | 63-118397 | U | 7/1988 |
| JP | 04-269399 | A | 9/1992 |
| JP | 05-17400 | B2 | 3/1993 |
| JP | 2002-106945 | A | 4/2002 |
| JP | 3303860 | B2 | 7/2002 |
| WO | WO-01/33144 | A1 | 5/2001 |

* cited by examiner

*Primary Examiner*—Melvin Jones
(74) *Attorney, Agent, or Firm*—Global IP Counselors, LLP

(57) ABSTRACT

An air conditioner includes a centrifugal fan and a unit casing that houses the centrifugal fan. The centrifugal fan includes an impeller and a scroll casing that houses the impeller. The unit casing has a unit intake port that opens in a direction crossing an opening direction of a scroll intake port. At a circumferential portion of the scroll intake port of the scroll casing, there is formed a bulged portion with an inner surface that is formed evenly in a circumferential direction and an outer surface portion formed away from the unit intake port that bulges out to a side opposite the impeller.

10 Claims, 8 Drawing Sheets

FAN AND AIR CONDITIONER

CROSS-REFERENCE TO RELATED APPLICATIONS

This U.S. National stage application claims priority under 35 U.S.C. §119(a) to Japanese Patent Application No. 2004-282405 filed in Japan on Sep. 28, 2004, the entire contents of which are hereby incorporated herein by reference.

TECHNICAL FIELD

The present invention relates to a fan and an air conditioner. More particularly, the present invention relates to a fan and an air conditioner, in which a centrifugal fan having an impeller and a scroll casing for housing the impeller is disposed inside a unit casing having a unit intake port that opens in a direction crossing an opening direction of a scroll intake port formed in the scroll casing, and in which gas is drawn into the scroll casing via the unit intake port of the unit casing.

BACKGROUND ART

Conventionally, there have been provided fans and air conditioners, in which a centrifugal fan having an impeller and a scroll casing for housing the impeller is disposed inside a unit casing, and in which gas is drawn into the scroll casing via a unit intake port of the unit casing.

As an example of such fans and air conditioners, there is provided a ceiling-hanging type air conditioner. Such a ceiling-hanging type air conditioner mainly includes a unit casing that can be hung from the ceiling, a centrifugal fan for drawing air into the unit casing via a unit intake port and for blowing out the air from a unit discharge port, and a heat exchanger.

The unit casing has the unit intake port formed on the bottom thereof and the unit discharge port formed at the front thereof. In addition, in the unit casing, there is disposed a partition member formed from a plate shaped member that is long in a lateral direction and disposed in a vertical direction. The partition member divides the space inside the unit casing into a fan chamber at the back side in communication with the unit intake port and a heat exchanger chamber at the front side in communication with the unit discharge port. To this partition member, there is formed a communication hole for communicating the fan chamber and the heat exchanger chamber with each other.

The centrifugal fan is disposed inside the fan chamber, and mainly includes an impeller, a scroll casing for housing the impeller, and a motor for rotatably driving the impeller. The impeller is, for example, a rotor of a sirocco fan of a double suction type, which is disposed such that its rotary shaft faces in a lateral direction of the unit casing. The scroll casing includes a scroll intake port that opens in an axial direction of the rotary shaft of the impeller, and a scroll discharge port that is formed so as to blow out air in a direction crossing the scroll intake port and is disposed so as to correspond to the communication hole of the partition member. With such an air conditioner, in many cases, a plurality of impellers and scroll casings are provided in a row in an axial direction of the rotary shaft of the impellers. In other words, they are often provided side by side in the lateral direction of the unit casing. In such a case, the plurality of impellers are rotatably driven all together by one motor.

The heat exchanger, which is disposed inside the heat exchanger chamber, is a device to cool or heat the air whose pressure is raised by the centrifugal fan in the fan chamber and which is then blown out from the scroll discharge port of the scroll casing into the heat exchanger chamber.

With such an air conditioner, by running the centrifugal fan, air is drawn into the fan chamber in the unit casing via the air unit intake port; the air drawn into the fan chamber is then drawn into the scroll casing through the scroll intake port; and the air is then blown out from an inner periphery of the impeller to an outer periphery thereof. The air which is blown out to the outer periphery of the impeller and whose pressure is raised is blown out into the heat exchanger chamber from the scroll discharge port disposed so as to correspond to the communication hole of the partition member. Then, the air blown out from the scroll discharge port to the heat exchanger chamber is cooled or heated by exchanging its heat with the refrigerant flowing inside a heat transfer tube of the heat exchanger, and the air is consequently blown out from the unit discharge port into the room (for example, refer to Japanese Laid-Open Patent Publication No. 2002-106945).

SUMMARY OF THE INVENTION

With the above-described conventional air conditioner, the unit intake port is formed on the bottom of the unit casing, and the scroll intake port opens in the axial direction of the rotary shaft of the impeller, in other words, in the lateral direction of the unit casing. Accordingly, the unit intake port is configured to open in a direction crossing an opening direction of the scroll intake port. Accordingly, in the case where the unit casing has the unit intake port that opens in the direction crossing the opening direction of the scroll intake port, when comparing the flow resistance of a portion of the scroll intake port near the unit intake port (here, lower portion of the scroll intake port) to the flow resistance of a portion of the scroll intake port far from the unit intake port (here, upper portion of the scroll intake port), the latter potion has a higher flow resistance; therefore the distribution of intake air flow (hereinafter referred to as the intake air distribution) becomes unbalanced, and a uniform distribution is difficult to obtain. Such an unbalance of the intake air distribution is a cause of the increase in noise and the reduction of the air blowing performance.

It is an object of the present invention to improve the intake air distribution at a scroll intake port in a fan and an air conditioner in which a centrifugal fan having an impeller and a scroll casing for housing the impeller is disposed inside a unit casing having a unit intake port that opens in a direction crossing an opening direction of a scroll intake port formed at the scroll casing, and in which gas is drawn into the scroll casing via the unit intake port of the unit casing.

A fan according to a first aspect of the present invention comprises a centrifugal fan and a unit casing. The centrifugal fan includes an impeller and a scroll casing that has a scroll intake port and houses the impeller. The unit casing has a unit intake port that opens in a direction crossing an opening direction of a scroll intake port, and the unit casing houses the centrifugal fan. In addition, at a circumferential portion of the scroll intake port, the scroll casing has a bulged portion whose inner surface is formed evenly in a circumferential direction and whose outer surface portion far from the unit intake port is formed such that it bulges out to the side opposite the impeller.

With this fan, at the circumferential portion of the scroll intake port, there is formed the bulged portion whose inner surface is formed evenly in the circumferential direction and whose outer surface portion far from the unit intake port bulges out to the side opposite the impeller. Consequently, it is possible to create, without changing the volume of the scroll casing, a condition that is similar to one in which the scroll intake port is disposed so as to incline to the unit intake port side, and the gas that is drawn in from the portion of the scroll intake port far from the unit intake port is easily guided. As a result, it is possible to improve the intake air distribution at the scroll intake port while maintaining the air blowing performance of the centrifugal fan, and it is thus possible to both improve the air blowing performance and reduce noise of the centrifugal fan and also the entire fan.

A fan according to a second aspect of the present invention is the fan according to the first aspect, wherein the bulged portion is formed unevenly such that the bulging distance increases from a portion near the unit intake port to a portion far therefrom toward the side opposite the impeller.

With this fan, the bulged portion is formed unevenly such that the bulging distance increases from the portion near the unit intake port to the portion far therefrom toward the side opposite the impeller. Consequently, it is possible to create a condition that is similar to one in which the scroll intake port is disposed so as to smoothly incline to the unit intake port side. As a result, it is possible to enhance the effect of improving the intake air distribution at the scroll intake port.

A fan according to a third aspect of the present invention is the fan according to the first or the second aspect, wherein the scroll casing has, at the circumferential portion of the scroll intake port, a plurality of ribs protruding to the side opposite the impeller. In addition, the outer surface of the bulged portion is formed by a surface that imaginary connects the plurality of ribs at their ends on the side opposite the impeller.

With this fan, the bulged portion is formed by the plurality of ribs that are provided at the circumferential portion of the scroll intake port so as to protrude to the side opposite the impeller. Consequently, it is possible to reduce the amount of materials to be used for the scroll casing, compared to the case where the bulged portion is formed as a solid bulged portion. Also, in the case where the scroll casing is formed as a resin molded product, it is possible to prevent the formation of a sink mark during molding. In addition, it is possible to improve the assemblability of the centrifugal fan and also the entire fan, compared to the case where the bulged portion is formed as a separate member.

An air conditioner according to a fourth aspect of the present invention comprises a centrifugal fan, a unit casing, a partition member, and a heat exchanger. The centrifugal fan includes an impeller and a scroll casing that has a scroll intake port and a scroll discharge port and houses the impeller. The unit casing has a unit discharge port and a unit intake port that opens in a direction crossing an opening direction of the scroll intake port, and houses the centrifugal fan. The partition member is a member that divides the space inside the unit casing into a fan chamber in communication with the unit intake port and a heat exchanger chamber in communication with the unit discharge port, and the partition member has a communication hole that is formed so as to communicate the fan chamber and the heat exchanger chamber with each other and to correspond to the scroll discharge port. The heat exchanger is disposed inside the heat exchanger chamber such that the air blown out from the scroll discharge port into the heat exchanger chamber passes through the heat exchanger and the air is then consequently blown out from the unit discharge port. In addition, at a circumferential portion of the scroll intake port, the scroll casing has a bulged portion whose inner surface is formed evenly in a circumferential direction and whose outer surface portion far from the unit intake port is formed such that it bulges out to the side opposite the impeller.

With this air conditioner, the bulged portion provided at the circumferential portion of the scroll intake port is formed such that its inner surface is formed evenly in the circumferential direction and its outer surface portion far from the unit intake port bulges out to the side opposite the impeller. Consequently, it is possible to create, without changing the volume of the scroll casing, a condition that is similar to one in which the scroll intake port is disposed so as to incline to the unit intake port side, and the gas that is drawn in from the portion of the scroll intake port far from the unit intake port is easily guided. As a result, it is possible to improve the intake air distribution at the scroll intake port while maintaining the air blowing performance of the centrifugal fan, and it is thus possible to reduce noise and improve the air blowing performance of the centrifugal fan and also the entire air conditioner.

DETAILED DESCRIPTION OF THE INVENTION

A selected embodiment of a fan and an air conditioner according to the present invention will now be described with reference to the drawings.

(1) Structure of Air Conditioner

Figure 1:
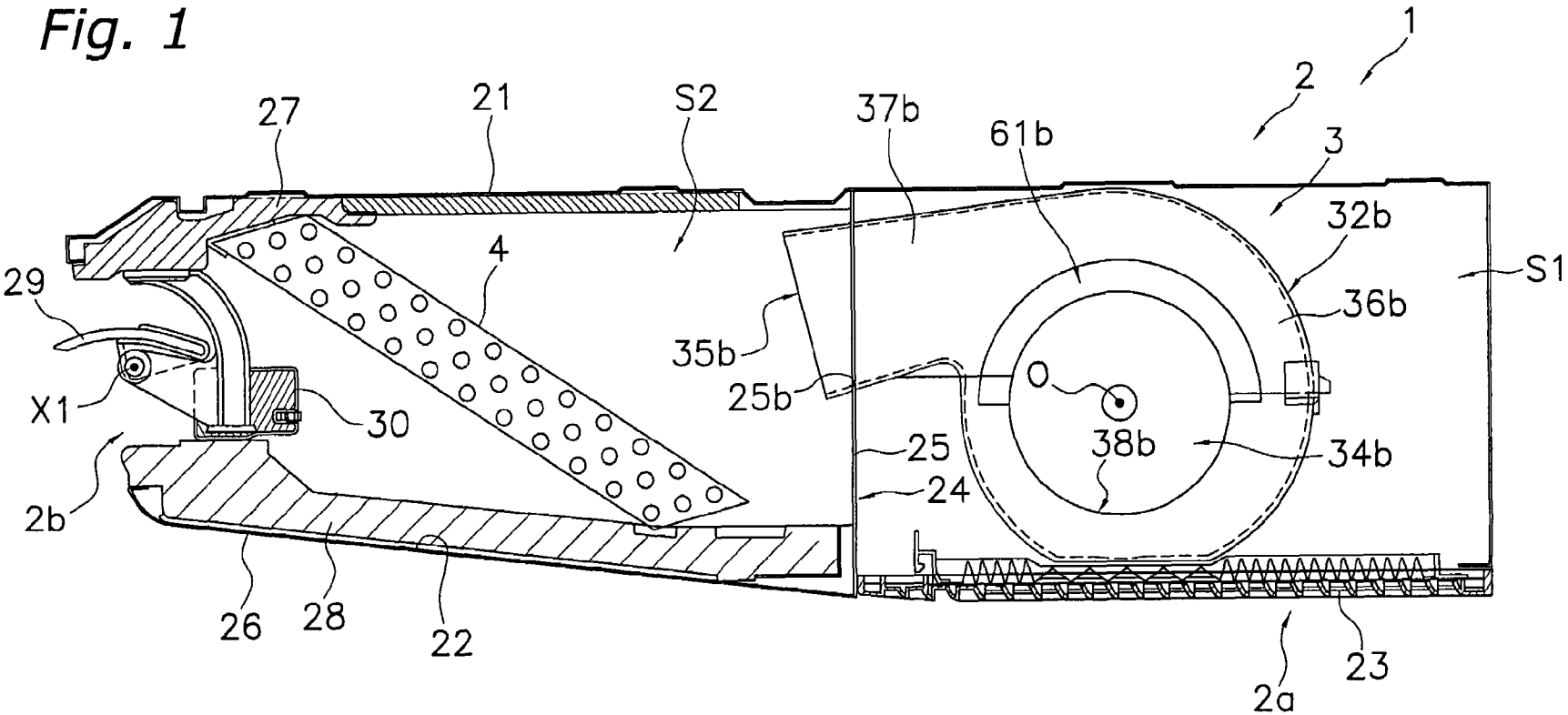
FIG. 1 is a side cross sectional view of an air conditioner of a ceiling-hanging type as an embodiment of a fan and an air conditioner according to the present invention.
Figure 2:
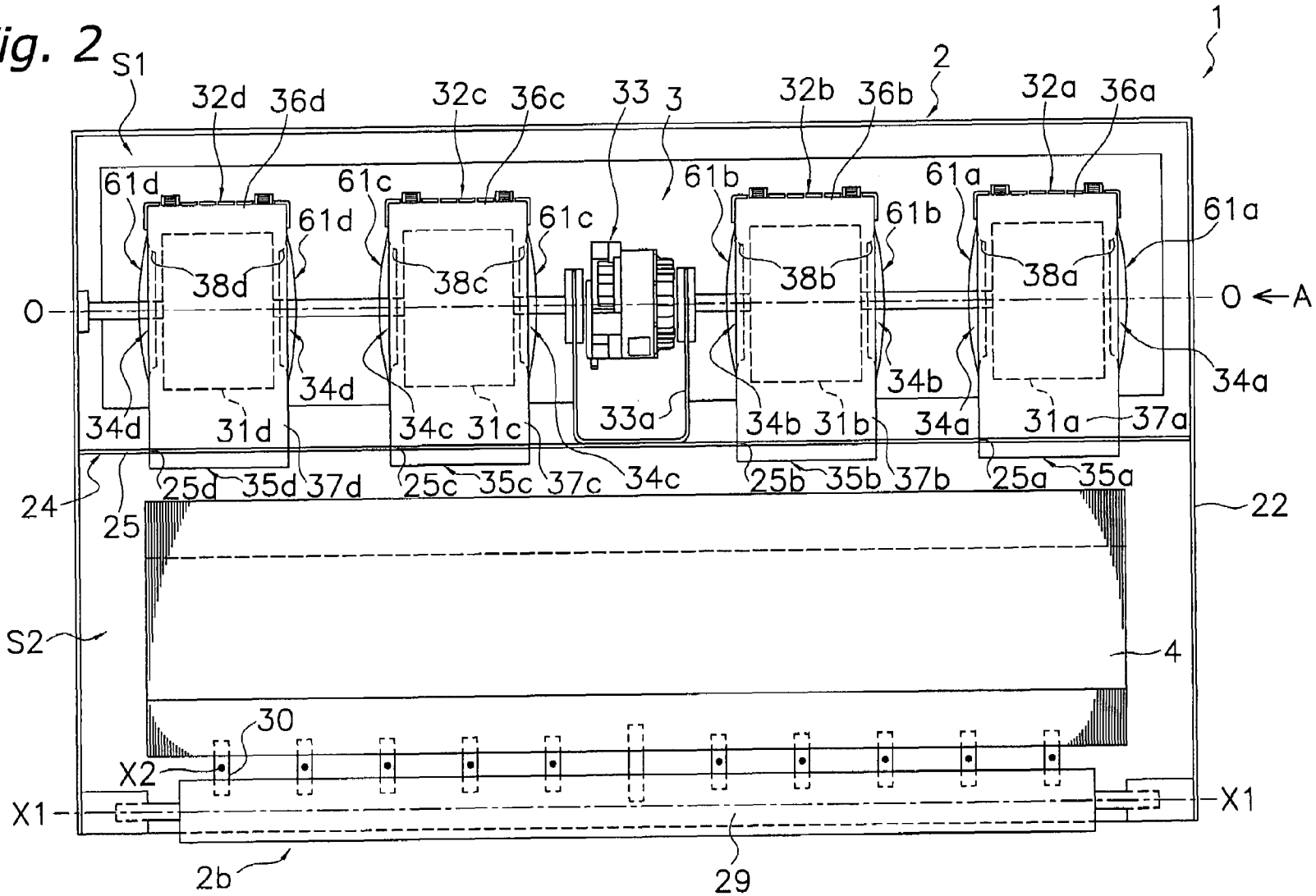
FIG. 2 is a top view of the air conditioner of the ceiling-hanging type (with the top of a unit casing removed) as an embodiment of the fan and the air conditioner according to the present invention.

FIG. 1 and FIG. 2 show an air conditioner of a ceiling-hanging type as an embodiment of a fan and an air conditioner according to the present invention. Here, FIG. 1 shows a side cross sectional view of an air conditioner 1 (a cross sectional view to show a scroll casing 32*b*). FIG. 2 is a top view of the air conditioner 1 (with the top of a unit casing 2 removed).

This air conditioner 1 is placed such that it is hung from the ceiling of an air-conditioned room. The air condition 1 is connected to an outdoor unit (not shown) disposed outside via a refrigerant connecting pipe (not shown).

The air conditioner 1 mainly comprises the unit casing 2, a centrifugal fan 3, and a heat exchanger 4.

<Unit Casing>

The unit casing 2 has a thin box shape that is long as a whole in a lateral direction, and is formed such that its height decreases from the back side to the front side. Provided at a portion on the back side of the bottom of the unit casing 2 is a unit intake port 2*a* which draws air inside the room into the unit casing 2. In addition, provided at the front of the unit casing 2 is a unit discharge port 2*b* which blows out the air that is cooled or heated from the unit casing 2 into the room.

More specifically, the unit casing 2 mainly has a top panel portion 21 that can be hung from the ceiling, a bottom panel portion 22 that is oppositely disposed from a front side portion of the top panel portion 21, and a intake grille 23 that is oppositely disposed from a back side portion of the top panel portion 21. The top panel portion 21 is a plate shaped member made of a metal, which is formed by bending a pair of side surfaces and a back surface by plate working. The intake grille 23 is removably mounted to the top panel portion 21, and constitutes the unit intake port 2*a*.

In addition, provided between the bottom panel portion 22 and the intake grille 23 of the unit casing 2 is a partition member 24 formed from a plate shaped member that is long in a lateral direction and disposed in a vertical direction. The partition member 24 divides the space inside the unit casing 2 into a fan chamber S1 on the back side in communication with the unit intake port 2*a* and a heat exchanger chamber S2 on the front side in communication with the unit discharge port 2*b*. More specifically, in this embodiment, the partition member 24 has a flat plate portion 25 that is parallel to the front and the back of the unit casing 2 (in other words, in a direction perpendicular to the sides of the unit casing 2). Also, in this flat plate portion 25, there are formed four communication holes 25*a* to 25*d*, which respectively correspond to scroll discharge ports 35*a* to 35*d* (described later) of four scroll casings 32*a* to 32*d* that constitute the centrifugal fan 3, and which communicate the fan chamber S1 and the heat exchanger chamber S2 with each other. The four communication holes 25*a* to 25*d* are disposed side by side in a longitudinal direction of the flat plate portion 25, and in this embodiment, they are polygonal holes in a horizontally long, rectangular shape.

The front, sides, and bottom of the unit casing 2 are covered by an decorative member 26 made of synthetic resin. In the vicinity of the unit discharge port 2*b* of the top panel portion 21, there is mounted an insulation member 27 that is made of, for example, polystyrene foam. In addition, inside the bottom panel portion 22, there is mounted a drain pan 28 that is made of, for example, polystyrene foam. These portions including the front side portion of the unit casing 2, the decorative member 26, a front side portion of the insulation member 27, and a front side portion of the drain pan 28 constitute the unit discharge port 2*b* that is substantially rectangular and long in a lateral direction.

The unit discharge port 2*b* is provided with a first flap 29 that oscillates in an up and down direction, and a plurality of second flaps 30 that oscillate in a left to right direction. The first flap 29 is formed from a plate shaped member that is long in a lateral direction, and is supported by the unit casing 2 such that it can freely oscillate about a first shaft X1 disposed along a longitudinal direction of the unit discharge port 2*b*. The plurality of second flaps 30 are supported by the unit casing 2 such that they can freely oscillate about their respective second shafts X2 that are located in a cross direction of the first shaft X1 and at positions on the back side of the first shaft X1.

<Centrifugal Fan>

The centrifugal fan 3, which is disposed inside the fan chamber S1, is a device to draw in air from the unit intake port 2*a* into the fan chamber S1, raise the pressure of the air, and blow out the air into the heat exchanger chamber S2 through the communication holes 25*a* to 25*d* of the partition member 24. Consequently, although the partition member 24 and the portion corresponding to the fan chamber S1 of the unit casing 2 are part of the air conditioner 1, they also serve as a unit casing of the fan, and the communication holes 25*a* to 25*d* of the partition member 24 serve as a unit discharge ports of this fan. Also, the centrifugal fan 3 mainly has four impellers 31*a* to 31*d*, the four scroll casings 32*a* to 32*d* that respectively house the impellers 31*a* to 31*d*, and a motor 33 that rotatably drives the impellers 31*a* to 31*d*.

Figure 3:
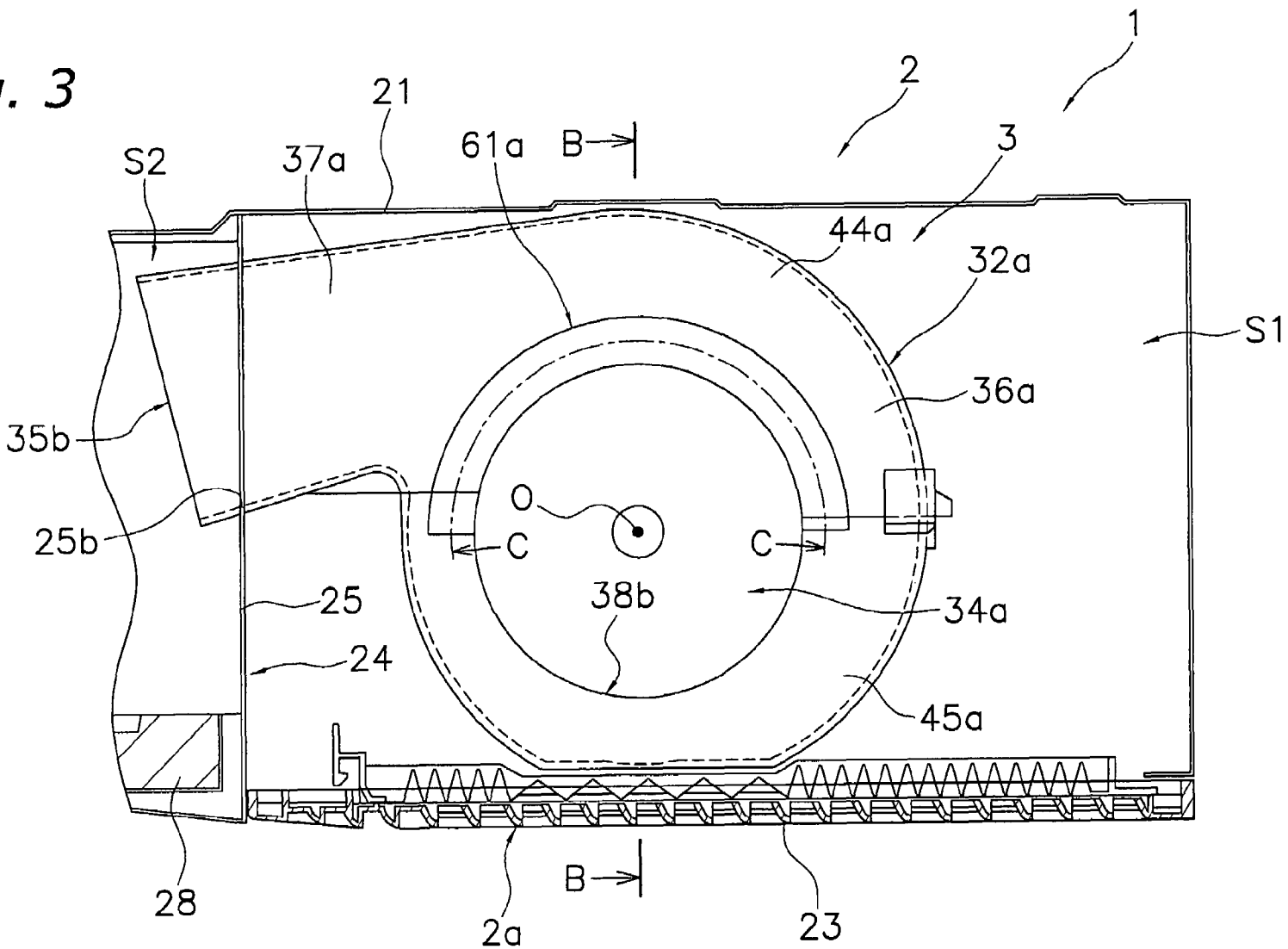
FIG. 3 shows the vicinity of a fan chamber (with the side of the unit casing removed) in FIG. 2 as viewed from direction A.
Figure 4:
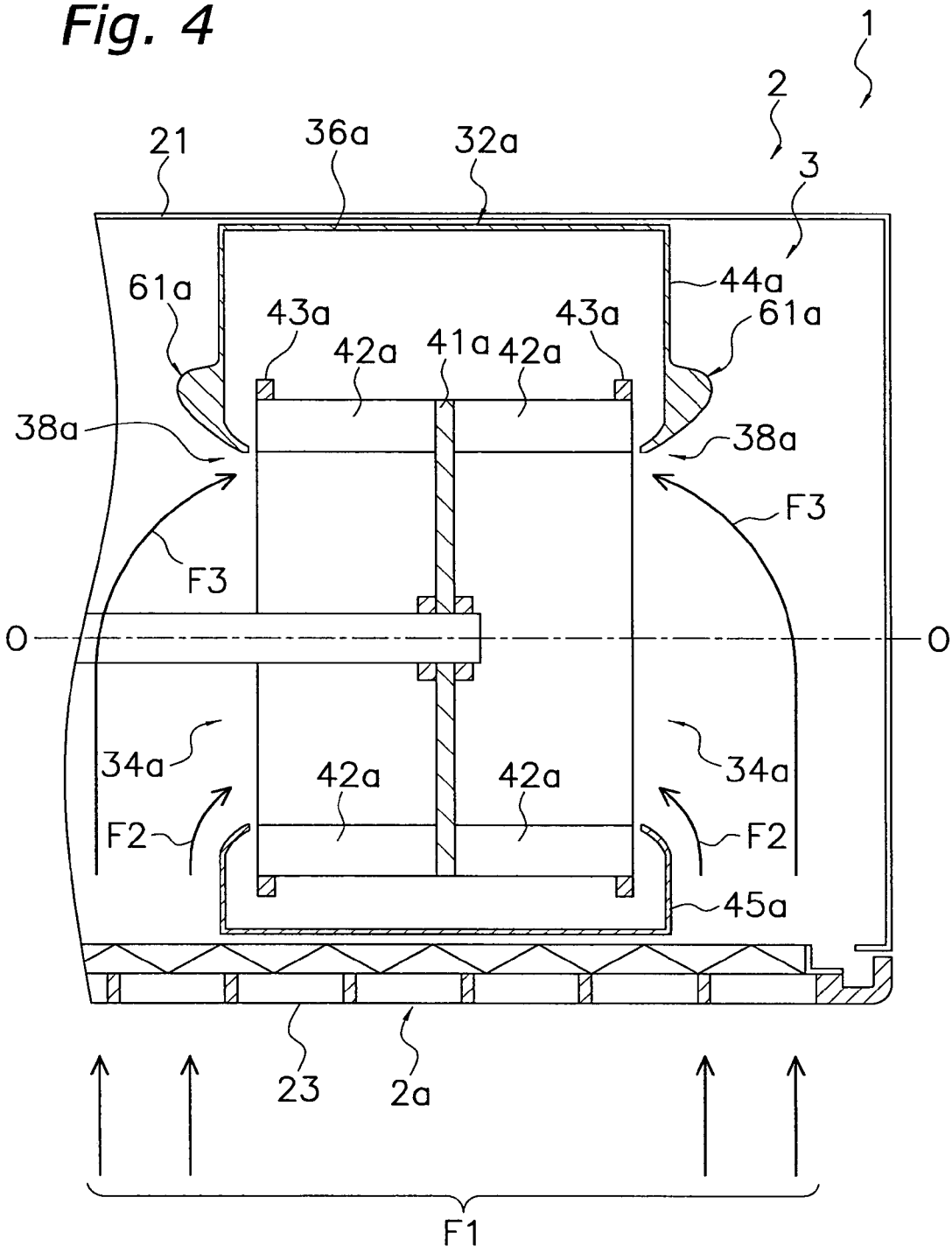
FIG. 4 is a cross sectional view of FIG. 3 taken along line B-B.

First, the impellers 31*a* to 31*d* will be described with reference to FIGS. 1 to 4. Here, FIG. 3 shows the vicinity of the fan chamber S1 (with the side of the unit casing 2 removed) in FIG. 2 as viewed from direction A. FIG. 4 is a cross sectional view (showing the vicinity of the scroll casing 32*a*) of FIG. 3 taken along line B-B. In this embodiment, the impellers 31*a* to 31*d* are rotors of a sirocco fan of a double suction type, and they are disposed side by side such that their rotary shaft O faces in the lateral direction of the unit casing 2. Note that since the impellers 31*a* to 31*d* all have the same structures, only the configuration of the impeller 31*a* will be described here. As for the configurations of the scroll casings 32*b* to 32*d*, symbols "b" to "d" will be used in lieu of the symbol "a" that represents a unit of the scroll casing 32*a*, and a description of each unit of the scroll casings 32*b* to 32*d* will be omitted.

The impeller 31*a* mainly includes: a main plate 41*a* in a disc shape that rotates about the rotary shaft O; a plurality of blades 42*a* that are disposed circularly about the rotary shaft O on the main plate 41*a* at its outer circumferential portions on both sides, with each one end fixed to the main plate 41*a*; and a pair of side plates 43*a* that are disposed at opposite sides of the main plate 41*a* in an axial direction of the rotary shaft O and that connect other ends of the plurality of blades 42*a*.

Next, the scroll casings 32*a* to 32*d* will be described. Note that since the scroll casing 32*a* to 32*d* all have the same structures, only the configuration of the scroll casing 32*a* will be described here. As for the configurations of the scroll casing 32*b* to 32*d*, symbols "b" to "d" will be used in lieu of the symbol "a" that represents a unit of the scroll casing 32*a*, and a description of each unit of the scroll casings 32*b* to 32*d* will be omitted.

The scroll casing 32*a* includes two scroll intake ports 34*a* that are respectively formed on both sides thereof so as to constitute the centrifugal fan of the double suction type, and a scroll discharge port 35*a* that is formed so as to blow out air in a direction crossing the scroll intake port 34*a*. Here, the scroll intake port 34*a* opens in the axial direction of the rotary shaft O of the impeller 31*a*. Consequently, the unit intake port 2*a* is configured to open in a direction crossing (more specifically, in a direction perpendicular to) an opening direction of the scroll intake port 34*a*. In addition, the scroll discharge port 35*a* is disposed so as to correspond to the communication hole 25*a* of the partition member 24.

More specifically, in this embodiment, the scroll casing 32*a* is a member made of resin, and has a split structure that is constituted by a scroll lower member 45*a* that covers the impeller 31*a* from below and a scroll upper member 44*a* that covers the impeller 31*a* from above. Assembling these members 44*a* and 45*a* results in the configuration of a scroll main body part 36*a* that has two scroll intake ports 34*a* and houses the impeller 31*a*, and the configuration of a scroll outlet portion 37*a* that has the scroll discharge port 35*a* and communicates with the scroll main body part 36*a*. The scroll main body part 36*a* has two bell mouth portions 38*a* formed thereon, which surround the circumference of each scroll intake port 34*a*. Each bell mouth portion 38*a* is formed such that its end portion on an inner peripheral side is curved in a bell shape toward the impeller 31*a* side. The scroll outlet portion 37*a* is a portion in a polygonal tubular shape, which communicates with a portion of the scroll main body part 36*a* on the partition member 24 side. The scroll discharge port portion 37*a* has a tip portion which is inserted in the communication hole 25*a* formed in the flat plate portion 25 of the partition member 24, and which protrudes from the flat plate portion 25 of the partition member 24 to the heat exchanger 4 side. In the plan view of the unit casing 2, the scroll outlet portion 37*a* extends straight in a direction substantially perpendicular to the flat plate portion 25, in other words, in a direction perpendicular to the rotary shaft O. In the side view of the unit casing 2, the scroll discharge port portion 37*a* inclines somewhat downward so that air can be easily blown out slightly downward.

Figure 5:
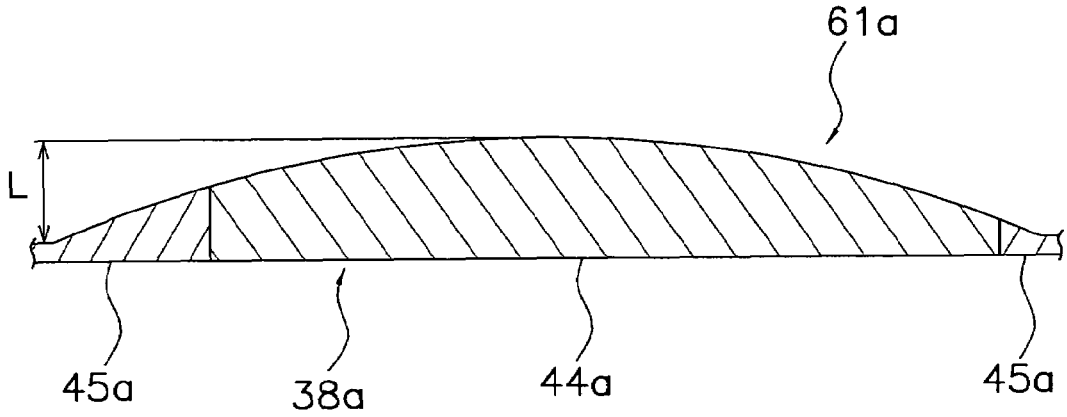
FIG. 5 is a cross sectional view of FIG. 3 taken along line C-C.

In addition, at a circumferential portion of each of the two scroll intake ports 34*a* (in other words, at the bell mouth portions 38*a*), the scroll casing 32*a* has a bulged portion 61*a* whose inner surface is formed evenly in a circumferential direction and whose outer surface portion far from the unit intake port 2*a* is formed such that it bulges out to the side opposite the impeller. In this embodiment, the bulged portion 61*a* is formed in a circular arc shape at a substantially upper portion of the bell mouth portions 38*a* (more specifically, at the entire portion constituting the bell mouth portions 38*a* of the scroll upper member 44*a* and an upper portion of the portion constituting the bell mouth portions 38*a* of the scroll lower member 45*a*). Also, in this embodiment, the bulged portion 61*a* is a solid portion that is formed integrally with the scroll casing 32*a* (specifically, the bell mouth portions 38*a*), and as shown in FIG. 5, the bulged portion 61*a* is formed smoothly unevenly such that the bulging distance L increases from a portion near the unit intake port 2*a* to a portion far therefrom toward the side opposite the impeller.

Figure 6:
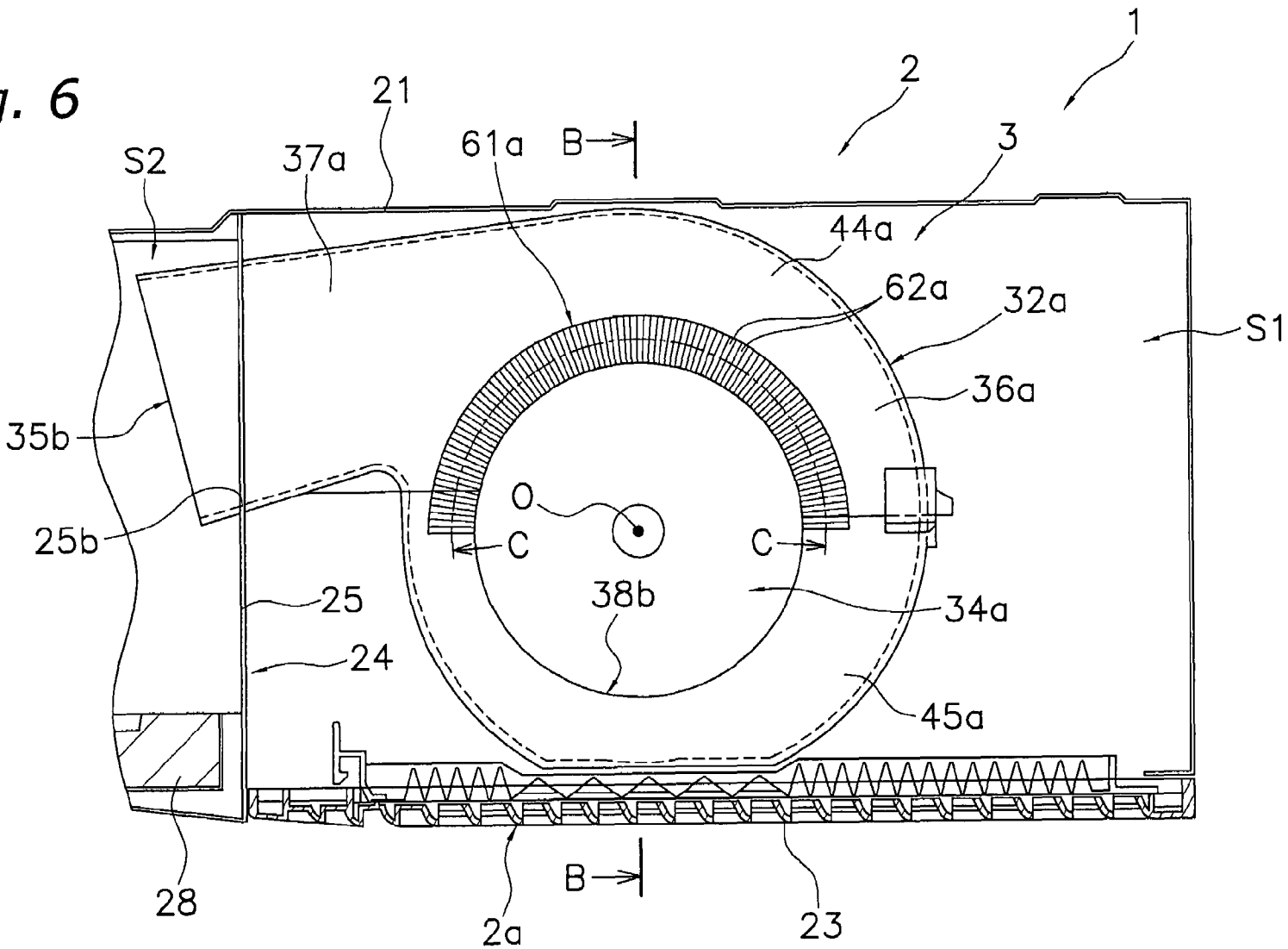
FIG. 6 is equivalent to FIG. 3, showing a first modified example of a bulged portion.
Figure 7:
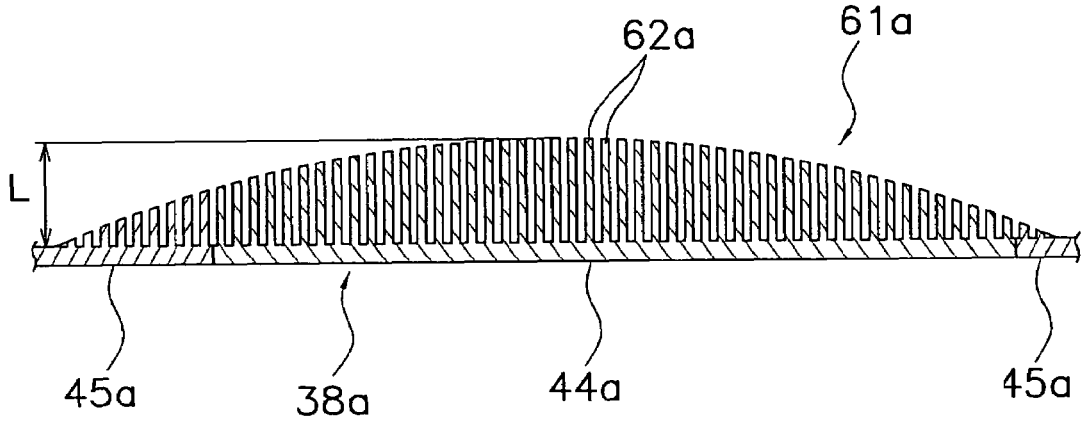
FIG. 7 is equivalent to FIG. 5, showing the first modified example of the bulged portion.
Figure 8:
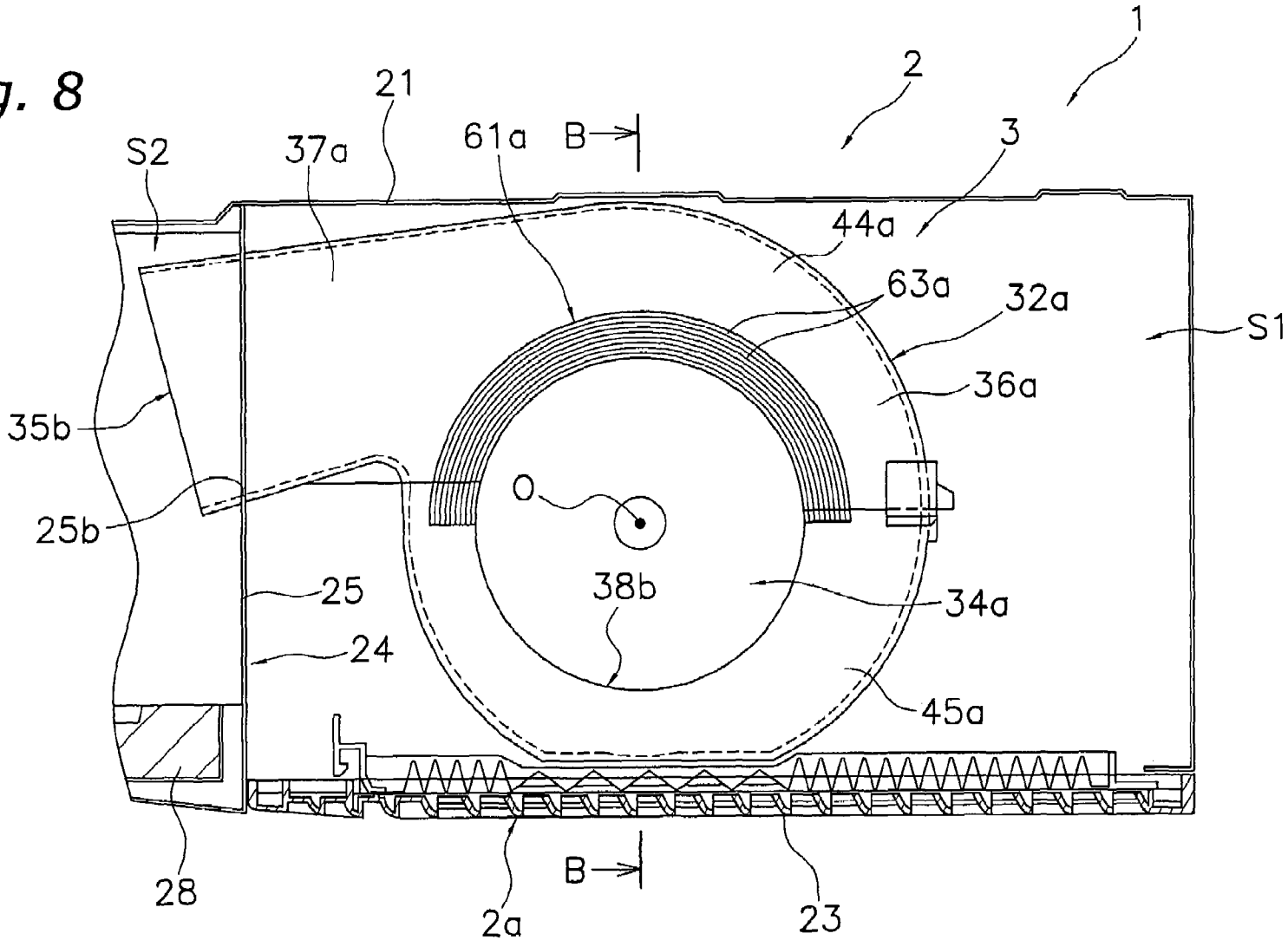
FIG. 8 is equivalent to FIG. 3, showing a second modified example of the bulged portion.

Also, in the case where the scroll casing 32*a* is formed as a resin molded product as in this embodiment, for the purpose of reducing the amount of resin materials to be used and preventing the formation of a sink mark during molding, a plurality of ribs 62*a* protruding to the side opposite the impeller may be provided radially at the circumferential portion of the scroll intake port 34*a*, as shown in FIGS. 6 and 7, in order to form the outer surface of the bulged portion 61*a* by a surface that imaginary connects these ribs 62*a* at their ends on the side opposite the impeller. Also, the plurality of ribs are not limited to those provided radially. For example, as shown in FIG. 8, a plurality of ribs 63*a* that are provided in a circular arc shape may be used. Also, the bulged portion 61*a* may be molded as a separate member and provided at the circumference of the scroll intake port 34*a* with adhesive and the like; however, which in this case will increase the number of assembly lines for the scroll casing 32*a*.

Further, in this embodiment, the bulged portion 61*a* is formed in the circular arc shape at the substantially upper portion of the bell mouth portions 38*a* (more specifically, at the entire portion constituting the bell mouth portions 38*a* of the scroll upper member 44*a* and the upper portion of the portion constituting the bell mouth portions 38*a* of the scroll lower member 45*a*); however, it is not limited to the above embodiment, and the bulged portion 61*a* may be formed only at the scroll upper member 44*a* (in other words, it does not have to be formed at the scroll lower member 45*a*). Also, even in the case where the bulged portion 61*a* is formed only at the scroll upper member 44*a*, the bulged portion 61*a* does not necessarily be formed at the entire portion constituting the bell mouth portions 38*a* of the scroll upper member 44*a*; the bulged portion 61*a* may be formed only at a part of the portion constituting the bell mouth portions 38*a* of the scroll upper member 44*a*. In addition, at the scroll intake ports 34*b* to 34*d* of the other scroll casings 32*b* to 32*d*, there are formed bulged portions 61*b* to 61*d* that are similar to the bulged portion 61*a* formed at the scroll casing 32*a* (when the bulged portions 61*b* to 61*d* are constituted by a plurality of ribs, ribs 62*b* to 62*d* or ribs 63*b* to 63*d* are formed).

Note that there are four impellers and four scroll casings in this embodiment; however, it is not limited to this number, and there may be one or two, or four or more of them. Also, in this embodiment, the impellers and the scroll casings are of the double suction type; however, they may be of a single suction type.

In this embodiment, the motor 33 is disposed between the scroll casing 32*b* and the scroll casing 32*c* in the plan view of the unit casing 2. The motor 33 is fixed to the partition member 24 and the unit casing 2 via a support member 33*a*. Accordingly, only the gap between the scroll casing 32*b* and the scroll casing 32*c* is large compared to gaps between other scroll casings (specifically, a gap between the scroll casing 32*a* and the scroll casing 32*b*, and a gap between the scroll casing 32*c* and the scroll casing 32*d*). Also, to this motor 33 is coupled all the four impellers 31*a* to 31*d*, and they can be rotatably driven all together.

By running the centrifugal fan 3, air is drawn into the fan chamber S1 in the unit casing 2 via the air unit intake port 2*a*; the air drawn into the fan chamber S1 is drawn into each scroll casing 32*a* to 32*d* through the scroll intake ports 34*a* to 34*d*; and the air is blown out from the inner periphery of each impellers 31*a* to 31*d* to the outer periphery thereof. The air, which is blown out to the outer periphery of each of these impellers 31*a* to 31*d* and whose pressure is raised, is blown out into the heat exchanger chamber S2 from each of the scroll discharge ports 35*a* to 35*d* of the scroll casings 32*a* to 32*d*, which are disposed so as to correspond to each of the communication holes 25*a* to 25*d* of the partition member 24.

<Heat Exchanger>

The heat exchanger 4, which is disposed inside the heat exchanger chamber S2, is a device to cool or heat the air whose pressure is raised by the centrifugal fan 3 in the fan chamber S1 and which is then blown out from the scroll discharge ports 35*a* to 35*d* of the scroll casings 32*a* to 32*d* into the heat exchanger chamber S2. In this embodiment, the heat exchanger 4 is a cross-fin tube type heat exchanger, and is disposed parallel to the flat plate portion 25 of the partition member 24. Accordingly, the heat exchanger 4 is oppositely disposed from the scroll discharge ports 35*a* to 35*d* of the scroll outlet portions 37*a* to 37*d*. In addition, the heat exchanger 4 is disposed such that an upper portion thereof inclines to the unit discharge port 2*b* side. Disposed under the heat exchanger 4 is the drain pan 28, which is capable of receiving dew condensation water generated in the heat exchanger 4.

As a result, the air blown out from the scroll discharge ports 35*a* to 35*d* to the heat exchanger chamber S2 is cooled or heated by exchanging its heat with the refrigerant flowing inside a heat transfer tube of the heat exchanger 4, and the air is then blown out from the unit discharge port 2*b* into the room.

(2) Operation of Air Conditioner

Next, the operation of the air conditioner 1 in this embodiment will be described with reference to FIGS. 1, 2, and 4.

By starting the motor 33 and running the centrifugal fan 3, air is drawn into the fan chamber S1 of the unit casing 2 via the unit intake port 2*a* (refer to airflow F1 in FIG. 4); the air drawn into the fan chamber S1 is then drawn into each of the scroll casings 32*a* to 32*d* through the scroll intake ports 34*a* to 34*d* (refer to airflows F2 and F3 in FIG. 4); and the air is blown out from the inner periphery of the impellers 31*a* to 31*d* to the outer periphery thereof. The air which is blown out to the outer peripheries of these impellers 31*a* to 31*d* and whose pressure is raised is then blown out into the heat exchanger chamber S2 from the scroll discharge ports 35*a* to 35*d* disposed so as to correspond to the communication holes 25*a* to 25*d* of the partition member 24. Then, the air blown out from the scroll discharge ports 35*a* to 35*d* to the heat exchanger chamber S2 is cooled or heated by exchanging its heat with the refrigerant flowing inside the heat transfer tube of the heat exchanger 4, and the air is blown out from the unit discharge port 2*b* into the room.

Here, with the air conditioner 1 in this embodiment, the unit intake port 2*a* is formed on the bottom of the unit casing 2, and the scroll intake ports 34*a* to 34*d* open in the axial direction of the rotary shaft O of the impellers 31*a* to 31*d*, in other words, in the lateral direction of the unit casing 2. Accordingly, the unit intake port 2*a* is configured to open in the direction crossing the opening direction of each of the scroll intake ports 34*a* to 34*d*. Accordingly, in the case where the unit casing 2 has the unit intake port 2*a* that opens in the direction crossing the opening direction of each of the scroll intake ports 34*a* to 34*d*, when comparing the flow resistance of portions of the scroll intake ports 34*a* to 34*d* near the unit intake port 2*a* (here, lower portions of the scroll intake ports 34*a* to 34*d*) to the flow resistance of portions of the scroll intake ports 34*a* to 34*d* far from the unit intake port (here, upper portions of the scroll intake port), the latter portions have a higher flow resistance; therefore the intake air distribution becomes unbalanced, and a uniform distribution is more likely to be difficult to obtain.

However, with the air conditioner 1 in this embodiment, at the circumferential portion of each of the scroll intake ports 34*a* to 34*d*, there is formed the bulged portion 61*a* whose inner surface is formed evenly in the circumferential direction and whose outer surface portion far from the unit intake port 2*a* bulges out to the side opposite the impeller. Consequently, it is possible to create, without changing the volume of the scroll casing 2, a condition that is similar to one in which the scroll intake ports 34*a* to 34*d* are disposed so as to incline to the unit intake port 2*a* side. As a result, airflow F3 that is drawn from the portions of the scroll intake ports 34*a* to 34*d* far from the unit intake port 2*a* is easily guided into the scroll casing 2. Accordingly, it is possible to improve the intake air distribution at the scroll intake ports 34*a* to 34*d* while maintaining the air blowing performance of the centrifugal fan 3, and it is thus possible to both reduce noise and improve the air blowing performance of the centrifugal fan 3 and also the entire air conditioner 1.

Furthermore, the bulged portion 61*a* is formed unevenly such that the bulging distance increases from a portion near the unit intake port 2*a* to a portion far therefrom toward the side opposite the impeller. Consequently, it is possible to create a condition that is similar to one in which the scroll intake ports 34*a* to 34*d* are disposed so as to smoothly incline to the unit intake port 2*a* side. As a result, the effect of improving the intake air distribution at the scroll intake ports 34*a* to 34*d* is more enhanced than before.

(3) Other Embodiments

While a selected embodiment of the present invention has been described based on the drawings, specific configurations are not limited to the above embodiments, and various changes and modifications may be made herein without departing from the scope of the invention.

(A)

In the above embodiment, an example in which the present invention is applied to a ceiling-hanging type air conditioner is explained. However, the present invention is not limited to the above example. The present invention can be applied to a ceiling embedded type air conditioner or a duct type air conditioner, in which a centrifugal fan having an impeller and a scroll casing that houses the impeller is disposed inside a unit casing having a unit intake port that opens in a direction crossing an opening direction of a scroll intake port formed in the scroll casing, and which has the structure for drawing air into the scroll casing via the unit intake port of the unit casing. The present invention can also be applied to a fan such as a filter unit or a ventilation unit.

(B)

In the above embodiment, the present invention is applied to the air conditioner in which the unit intake port is formed on the bottom of the unit casing, and the scroll casing is disposed such that the scroll intake port opens in the lateral direction, and the bulged portion is provided at the substantially upper portion of the circumference of the scroll intake port. However, in the case where the unit intake port is formed at a different portion of the unit casing, the bulged portion may be provided elsewhere according to the position of the unit intake port. For example, in the case where the unit intake port is formed at the back of the unit casing, the bulged portion may be provided at a substantially half portion of the front side of the unit casing that surrounds the scroll intake port (on the partition member side in FIG. 3).

INDUSTRIAL APPLICABILITY

Application of the present invention enables an improvement of the intake air distribution at a scroll intake port in a fan and an air conditioner, in which a centrifugal fan having an impeller and a scroll casing for housing the impeller is disposed inside a unit casing having a unit intake port that opens in a direction crossing an opening direction of a scroll intake port formed at the scroll casing, and in which gas is drawn into the scroll casing via the unit intake port of the unit casing.

What is claimed is:

1. A fan comprising:

a centrifugal fan including an impeller and a scroll casing that houses the impeller, the scroll casing having a scroll intake port; and a unit casing having an unit intake port that opens in a direction crossing an opening direction of the scroll intake port, the unit casing being configured to house the centrifugal fan, the scroll casing having a bulged portion at a circumferential portion of the scroll intake port, the bulged portion having an inner surface that is formed evenly in a circumferential direction and an outer surface portion formed away from the unit intake port that bulges out to a side opposite the impeller, the bulged portion being formed unevenly such that a bulging distance increases from a portion near the unit intake port to a portion away from the unit intake port toward the side opposite the impeller.

2. A fan comprising:

a centrifugal fan including an impeller and a scroll casing that houses the impeller, the scroll casing having a scroll intake port; and a unit casing having an unit intake port that opens in a direction crossing an opening direction of the scroll intake port, the unit casing being configured to house the centrifugal fan, the scroll casing having a bulged portion at a circumferential portion of the scroll intake port, the bulged portion having an inner surface that is formed evenly in a circumferential direction and an outer surface portion formed away from the unit intake port that bulges out to a side opposite the impeller, the bulged portion being formed by a plurality of ribs formed at the circumferential portion of the scroll intake port that protrude to the side opposite the impeller with the ribs having free ends defining an imaginary outer surface of the bulged portion on the side opposite the impeller.

3. An air conditioner comprising:

a centrifugal fan including an impeller and a scroll casing that houses the impeller, the scroll casing having a scroll intake port and a scroll discharge port;

a unit casing having an unit intake port that opens in a direction crossing an opening direction of the scroll intake port and a unit discharge port, the unit casing being configured to house the centrifugal fan;

a partition member dividing a space inside the unit casing into a fan chamber in communication with the unit intake port and a heat exchanger chamber in communication with the unit discharge port, the partition member including a communication hole formed to allow the fan chamber and the heat exchanger chamber to communicate with each other and to correspond to the scroll discharge port; and a heat exchanger disposed inside the heat exchanger chamber such that air blown into the heat exchanger chamber from the scroll discharge port passes therethrough and then is blown out from the unit discharge port, the scroll casing having a bulged portion at a circumferential portion of the scroll intake port, the bulged portion having an inner surface that is formed evenly in a circumferential direction and an outer surface portion formed away from the unit intake port that bulges out to a side opposite the impeller side.

4. The fan according to claim 1, wherein the bulged portion is formed by a plurality of ribs formed at the circumferential portion of the scroll intake port that protrude to the side opposite the impeller with the ribs having free ends defining an imaginary outer surface of the bulged portion on the side opposite the impeller.

5. The air conditioner according to claim 3, wherein the bulged portion is formed unevenly such that a bulging distance increases from a portion near the unit intake port to a portion away from the unit intake port toward the side opposite the impeller.

6. The air conditioner according to claim 5, wherein the bulged portion is formed by a plurality of ribs formed at the circumferential portion of the scroll intake port that protrude to the side opposite the impeller with the ribs having free ends defining an imaginary outer surface of the bulged portion on the side opposite the impeller.

7. The air conditioner according to claim 3, wherein the bulged portion is formed by a plurality of ribs formed at the circumferential portion of the scroll intake port that protrude to the side opposite the impeller with the ribs having free ends defining an imaginary outer surface of the bulged portion on the side opposite the impeller.

8. The fan according to claim 1, wherein the inner surface at the bulged portion is formed evenly in a circumferential direction without changing the volume of the scroll casing.

9. The fan according to claim 2, wherein the inner surface at the bulged portion is formed evenly in a circumferential direction without changing the volume of the scroll casing.

10. The fan according to claim 3, wherein the inner surface at the bulged portion is formed evenly in a circumferential direction without changing the volume of the scroll casing.

* * * * *